US008600753B1

(12) United States Patent
Conkie

(10) Patent No.: US 8,600,753 B1
(45) Date of Patent: Dec. 3, 2013

(54) METHOD AND APPARATUS FOR COMBINING TEXT TO SPEECH AND RECORDED PROMPTS

(75) Inventor: Alistair Conkie, Morristown, NJ (US)

(73) Assignee: AT&T Intellectual Property II, L.P., Atlanta, GA (US)

( * ) Notice: Subject to any disclaimer, the term of this patent is extended or adjusted under 35 U.S.C. 154(b) by 1246 days.

(21) Appl. No.: 11/321,638

(22) Filed: Dec. 30, 2005

(51) Int. Cl.
*G10L 13/00* (2006.01)
*G10L 13/08* (2013.01)

(52) U.S. Cl.
USPC ..... 704/260; 704/266; 704/269

(58) Field of Classification Search
USPC ..... 704/258, 260, 267, 261, 266, 269
See application file for complete search history.

(56) References Cited

U.S. PATENT DOCUMENTS

| | | | | |
|---|---|---|---|---|
| 5,875,427 | A * | 2/1999 | Yamazaki | 704/258 |
| 5,915,001 | A * | 6/1999 | Uppaluru | 704/270.1 |
| 5,970,454 | A * | 10/1999 | Breen | 704/269 |
| 6,175,821 | B1 * | 1/2001 | Page et al. | 704/258 |
| 6,182,028 | B1 * | 1/2001 | Karaali et al. | 704/9 |
| 6,226,614 | B1 * | 5/2001 | Mizuno et al. | 704/260 |
| 6,345,250 | B1 * | 2/2002 | Martin | 704/260 |
| 6,349,277 | B1 * | 2/2002 | Kamai et al. | 704/207 |
| 6,446,040 | B1 * | 9/2002 | Socher et al. | 704/260 |
| 6,490,562 | B1 * | 12/2002 | Kamai et al. | 704/258 |
| 6,553,341 | B1 * | 4/2003 | Mullaly et al. | 704/9 |
| 6,584,181 | B1 * | 6/2003 | Aktas et al. | 379/88.23 |
| 6,665,641 | B1 * | 12/2003 | Coorman et al. | 704/260 |
| 6,725,199 | B2 * | 4/2004 | Brittan et al. | 704/258 |
| 6,810,378 | B2 * | 10/2004 | Kochanski et al. | 704/258 |
| 7,016,847 | B1 * | 3/2006 | Tessel et al. | 704/275 |
| 7,092,873 | B2 * | 8/2006 | Engelsberg et al. | 704/200.1 |
| 7,099,826 | B2 * | 8/2006 | Akabane et al. | 704/260 |
| 7,502,739 | B2 * | 3/2009 | Saito et al. | 704/260 |
| 7,599,838 | B2 * | 10/2009 | Gong et al. | 704/258 |
| 7,672,436 | B1 * | 3/2010 | Thenthiruperai et al. | 379/88.04 |
| 7,912,718 | B1 * | 3/2011 | Conkie et al. | 704/258 |
| 8,214,216 | B2 * | 7/2012 | Sato | 704/258 |
| 2002/0032563 | A1 * | 3/2002 | Kamai et al. | 704/258 |
| 2002/0193996 | A1 * | 12/2002 | Squibbs et al. | 704/260 |
| 2004/0054535 | A1 * | 3/2004 | Mackie et al. | 704/260 |
| 2005/0149330 | A1 * | 7/2005 | Katae | 704/267 |
| 2006/0136214 | A1 * | 6/2006 | Sato | 704/265 |
| 2007/0055526 | A1 * | 3/2007 | Eide et al. | 704/260 |
| 2007/0078656 | A1 * | 4/2007 | Niemeyer et al. | 704/260 |
| 2007/0233489 | A1 * | 10/2007 | Hirose et al. | 704/258 |
| 2008/0077407 | A1 * | 3/2008 | Beutnagel et al. | 704/261 |
| 2009/0299746 | A1 * | 12/2009 | Meng et al. | 704/260 |
| 2009/0306986 | A1 * | 12/2009 | Cervone et al. | 704/260 |
| 2012/0035933 | A1 * | 2/2012 | Conkie et al. | 704/260 |

FOREIGN PATENT DOCUMENTS

WO WO 2006/128480 * 12/2006

OTHER PUBLICATIONS

Andrew J. Hunt et al., Unit Selection in a Concatenative Speech Synthesis System Using a Large Speech Database, IEEE 1996, Proc. ICASSP-96, May 7-10, Atlanta, GA, pp. 1-4.

* cited by examiner

*Primary Examiner* — Martin Lerner

(57) ABSTRACT

An arrangement provides for improved synthesis of speech arising from a message text. The arrangement stores prerecorded prompts and speech related characteristics for those prompts. A message is parsed to determine if any message portions have been recorded previously. If so then speech related characteristics for those portions are retrieved. The arrangement generates speech related characteristics for those parties not previously stored. The retrieved and generated characteristics are combined. The combination of characteristics is then used as the input to a speech synthesizer.

9 Claims, 2 Drawing Sheets

METHOD AND APPARATUS FOR COMBINING TEXT TO SPEECH AND RECORDED PROMPTS

BACKGROUND

The invention relates generally to an arrangement which provides speech output and more particularly to an arrangement that combines recorded speech prompts with speech that is produced by a synthesizing technique.

Current applications requiring speech output, depending on the task, may use announcements or interactive prompts that are either recorded or generated by text-to-speech synthesis (TTS). Unit section TTS techniques, such as those described in "Unit Selection in a Concatenative Speech Synthesis System Using Large Speech Database" by Hunt et al., Proc. IEEE Intl. Conf. Acoustic, Speech, Signal Processing, pp. 373-376, 1996, yield what is considered high-quality synthesis, but results are nevertheless significantly less intelligible and natural than recorded speech. Recorded prompts are often preferred in situations where (a) there are a limited number of basically fixed prompts required for the application and/or (b) the speech is required to be of very high quality. An example might be the welcoming initial prompt for an Interactive Voice Response (IVR) system, introducing the system. TTS is used in situations where the vocabulary of an application is prohibitively large to be covered by recorded speech or where an IVR system needs to be able to respond in a very flexible way. One example, might be a reverse telephone directory for name and address information.

The advantage of TTS lies in the almost infinite range of responses possible, the low cost, high efficiency, and flexibility of being able to experiment with a wide range of utterances (especially for rapid prototyping of a service). The main disadvantage is that quality is currently lower than that of recorded speech.

While recorded speech has the advantage of higher speech quality, its disadvantages are lack of flexibility, both short term and long term, low scalability, high storage requirements for recorded speech files, and the high cost of recording a high quality voice, especially if additional material may be required later.

Depending on the application requirements, the appropriateness of one or the other type of speech output will vary. Many applications attempt to compromise, or benefit from the best aspects of both, some by combining TTS with recorded prompts, some by adopting one of the following methods.

Limited domain synthesis is a technique for achieving high quality synthesis by specializing and carefully designing the recorded database. An example of a limited domain application might be weather report reading for a restricted geographical region. The system may also rely on constraining the structure of the output in order to achieve the quality gains desired. The approach is automated, and the quality gains are a function of the choice of domain and of the database.

Another method for which much work has been done is in allowing the customization of automatic text to speech. This technique comes under the general heading of adding control or escape sequences to the text input, more recently called markup. Diphone synthesis systems frequently allow the user to insert special character sequences into the text to influence the way that things get spoken (often including an escape character, hence the name). The most obvious example of this would be where a different pronunciation of a word is desired compared with the system's default pronunciation. Markup can also be used to influence or override prosodic treatment of sentences to be synthesized, e.g., to add emphasis to a word. Such systems basically fall into three categories: (a) nearly all systems have escape or control sequences that are system specific; (b) standardized markup for synthesis e.g., SSML (See SSML: A speech synthesis markup language, Speech Communication, Vol. 21, pp. 123-133, 1997, the entirety of which is incorporated herein by reference); and (c) more generally a kind of mode based on the type of a document or dialog schema, such as SALT (See SALT: a spoken language interface for web-based multimodal dialog system, Intl. Conf. on Spoken Language processing ICSLP 2002, pp. 2241-2244), which subsumes SSML.

A block diagram of a typical concatenative TTS system is shown in FIG. 1. The first block 101 is the message text analysis module that takes ASCII message text and converts it to a series of phonetic symbols and prosody (fundamental frequency, duration, and amplitude) targets. The text analysis module actually consists of a series of modules with separate, but in many cases intertwined, functions. Input text is first analyzed and non-alphabetic symbols and abbreviations are expanded to full words. For example, in the sentence "Dr. Smith lives at 4035 Elm Dr.", the first "Dr." is transcribed as "Doctor", while the second one is transcribed are "Drive". Next, "4305" is expanded to "forty three oh five". Then, a syntactic parser (recognizing the part of speech for each word in the sentence) is used to label the text. One of the functions of syntax is to disambiguate the sentence constituent pieces in order to generate the correct string of phones, with the help of a pronunciation dictionary. Thus for the above sentence, the verb "lives" is disambiguated from the (potential) noun "lives" (plural of "life). If the dictionary look-up fails, general letter-to-sound rules are used (Dictionary rules module 103). Finally, with punctuated text, syntactic and phonological information available, a prosody module predicts sentence phrasing and word accents, and, from those, generates targets for example, for fundamental frequency, phoneme duration, and amplitude. The second block 110 in FIG. 1 assembles the units according to the list of targets set by the front-end. It is this block that is responsible for the innovation towards more natural sounding synthetic speech with reference to a store of sounds. Then the selected units are fed into a back-end speech synthesizer 120 that generates the speech waveform for presentation to the listener.

This known arrangement simply does not accommodate well an arrangement in which TTS is combined with recorded prompts.

SUMMARY

In an arrangement in accordance with an embodiment of the invention, text for conversion into speech is analyzed for tags designating portions corresponding to sounds stored in a database associated with the process.

The database stores information regarding the phonemes, durations, pitches, etc., with respect to the marked/tagged sounds. The arrangement retrieves this previously stored information regarding the sounds in question and combines it with other information about other sounds to be produced in relation to the text of a message to be conveyed aurally. The combined stream of sound information (e.g., phonemes, durations, pitches etc.) are processed according to a synthesis algorithm to yield a speech output.

DETAILED DESCRIPTION

Figure 1:
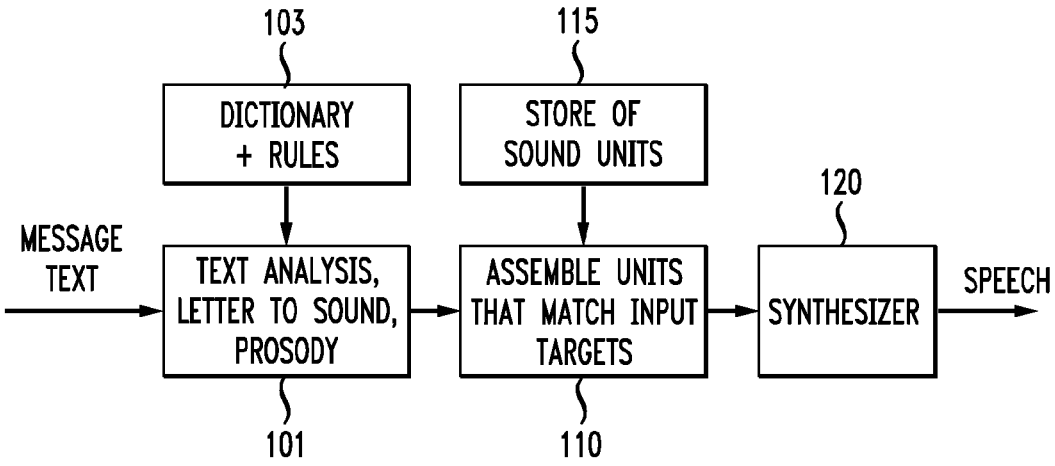
FIG. 1 PRIOR ART
FIG. 1 illustrates a version of a known text to speech arrangement.

The arrangements according to the invention provide a new methodology for producing synthesized speech which takes advantage of information related to recorded prompts. The arrangement accesses a database of stored information related to pre-recorded prompts. Speech characteristics such as phonemes, duration, pitch, etc., for a particular speech portion of the text are accessed from the database when that speech portion has been tagged. The retrieved characteristics are then combined with the characteristics otherwise retrieved from the dictionary and rules. The combined speech characteristics are presented to the Unit Assembler which then retrieves sound units in accordance with the designated speech characteristics. The assembled units are presented to the synthesizer to ultimately produce a signal representative of synthesized speech.

Intended areas of application of the system described here are at least threefold. First, for domain-specific tasks it is often necessary for reasons of quality to use recorded prompts rather than automatic synthesis. Most tasks are not completely closed, and it may be necessary for practical reasons to include an element of synthesis. One example would be where, in an otherwise constrained application, there is a requirement to read proper names. A second example is where for combinatorial reasons there are just too many prompts to record (e.g., combinations of types, colors and sizes of clothing in a retail application). This type of combination is often called slot-filling.

Secondly, even for an application where the range of utterances is relatively limited or stylized there may be a need to modify the system from time to time and the original speaker may no longer be available. An example would be where the name of an airport is changed or added to a travel domain application.

Thirdly, it is often the case that a traditional IVR application has to commit early on to a list of prompts to be used in the system. There is no chance to prototype and to consider usability factors. The use of a TTS system provides the opportunity for flexibility in application design through prototyping, but generally achieves it at the expense of less realistic sounding speech prompts. Creating hybrid prompts with the modified TTS approach allows a degree of tuning which may be helpful in building the application, while maintaining a high degree of naturalness.

A database for this work can be created using a single speaker recorded in a studio environment, speaking material appropriate for a general purpose speech synthesis system. Additionally, for the application, domain-specific material can be recorded by the same speaker. This extra material is similar in nature to prompts that are required for the application, and variants on these prompts. In the general case, any anticipated future material can also most easily be added at this point.

The preparation of the database is one key part of the process. In addition to indexing the material with features of various kinds (e.g., phoneme identity, duration, pitch) the material is indexed (or tagged) by specific prompt name(s), which can include material that effectively constitutes a slot-filling style of prompt. This allows identification of the data in the database when synthesis is taking place.

The synthetic voice can then be prepared in the usual manner, but including the extra tags where appropriate.

The database 230 can be used as a general purpose database, and given that the material is biased towards domain-specific material, better quality can be expected with this configuration than with voice not containing domain-specific material. So, just having the domain specific material, when correctly incorporated, will improve the synthesis quality of in-domain sentences. This process does not require any text markup. However, another mode of operation is provided that gives even finer control over the database. That is, the parameters of the material to synthesize are explicitly described in such a way that the units in the database can be chosen with more discrimination, and without making any modification whatsoever to the unit selection algorithm. So the algorithm will still try to provide the best set of units, based on the required specification, in terms of what it knows about target and join costs.

The front-end of the synthesizer can be provided with a method of marking up input text. Markup is commonly used for a number of purposes and so markup processing is almost always already built into the TTS system. A general type of markup such as a bookmark which is essentially user defined can be used as a stand-in for a specific new tag. Such tags are generally passed through the front-end without modification and can be in the simplest case intercepted before the output of the front-end and specification modifications are made. An additional markup tag pair can be provided in the text to be processed by the TTS system. For example:

<tag 107*a*> I don't really want to fly </tag 107*a*> Continental <tag 107*b*> on this trip. Are there any other options? </tag 107*b*>

Here the intention to insert a portion of the database index is signaled by the opening <id> and closing tags </id>. The database has been previously labeled with such tags, as discussed above. Note that there is no explicit connection between the words between the tags and what is in the actual table of data. The user still has to do the hard work of deciding which tags are relevant and what they should contain. But this is something that is part of building an IVR application, and so doesn't constitute an extra overhead in the process.

Figure 2:
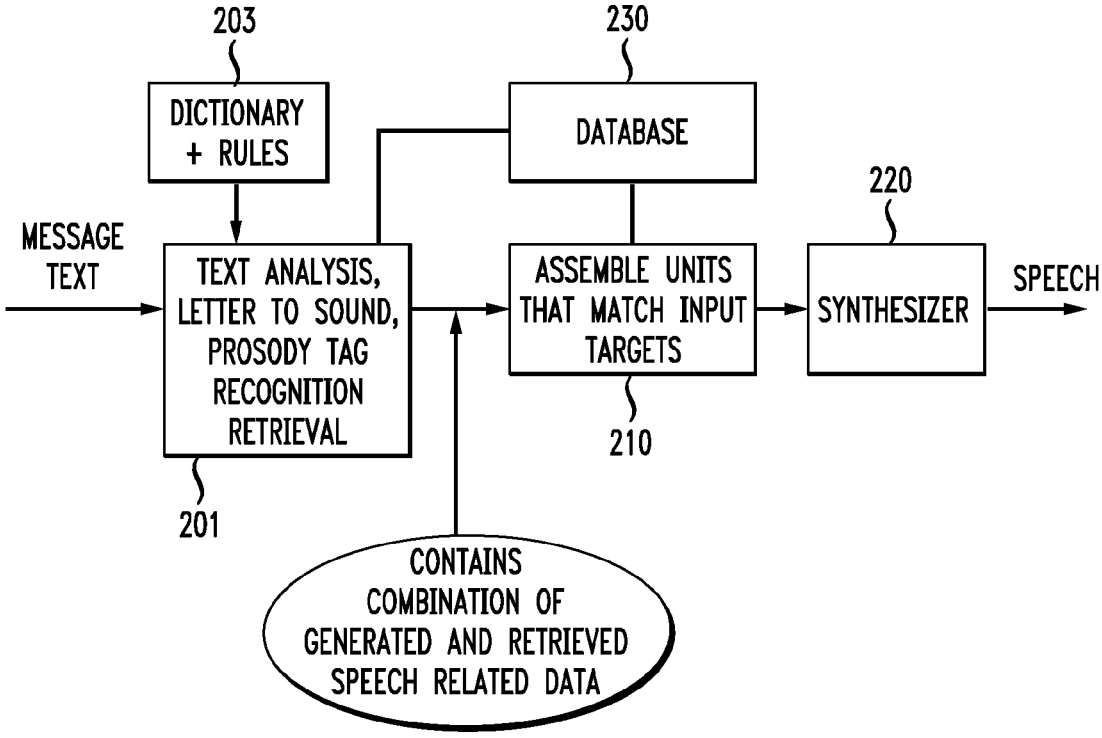
FIG. 2 illustrates an arrangement of an embodiment of the invention.

Referring to FIG. 2, when the front-end encounters a tag pair, as above, the text between the tags will be processed differently. The normal procedure is that all the text is passed through the front-end and is converted into a list of phonemes, durations, pitches and other information required for identifying suitable units in the speech database referring to the dictionary rules 203 and the text analysis portion 205. With the tags present the phonemes, durations, pitches and other information that lie between the tags are substituted by the phonemes, durations, pitches and other information corresponding to the part of the database labeled by the tag. This occurs because the text analysis element incorporates a tag recognition/database retrieval function that causes the element to retrieve information from the database 230. Because of this, at unit selection time, there will be a very high probability that the units chosen will be the units labeled with the tag.

Unit selection synthesis and subsequent components of the system are then done in the normal manner, without any special processing whatsoever. Unit selection is effective in finding units at the boundaries in order to blend the prompt carrier phrase with the "slot" word synthesized by the general TTS (i.e. "Continental" in the example above). The resulting hybrid prompt is a smoothly articulated continuous utterance without awkward and unnatural pauses that accompany standard slot-filling methods of concatenating two or more recordings or concatenating recordings and normal TTS synthesis.

If some completely new prompt is required that was not specifically recorded for the database, then the system can fall back to high quality TTS. At some later stage, new material can be added to the database if required. The whole process is more convenient in that it does not require changing the application, only the database and perhaps the addition of some markup if desired.

Figure 3:
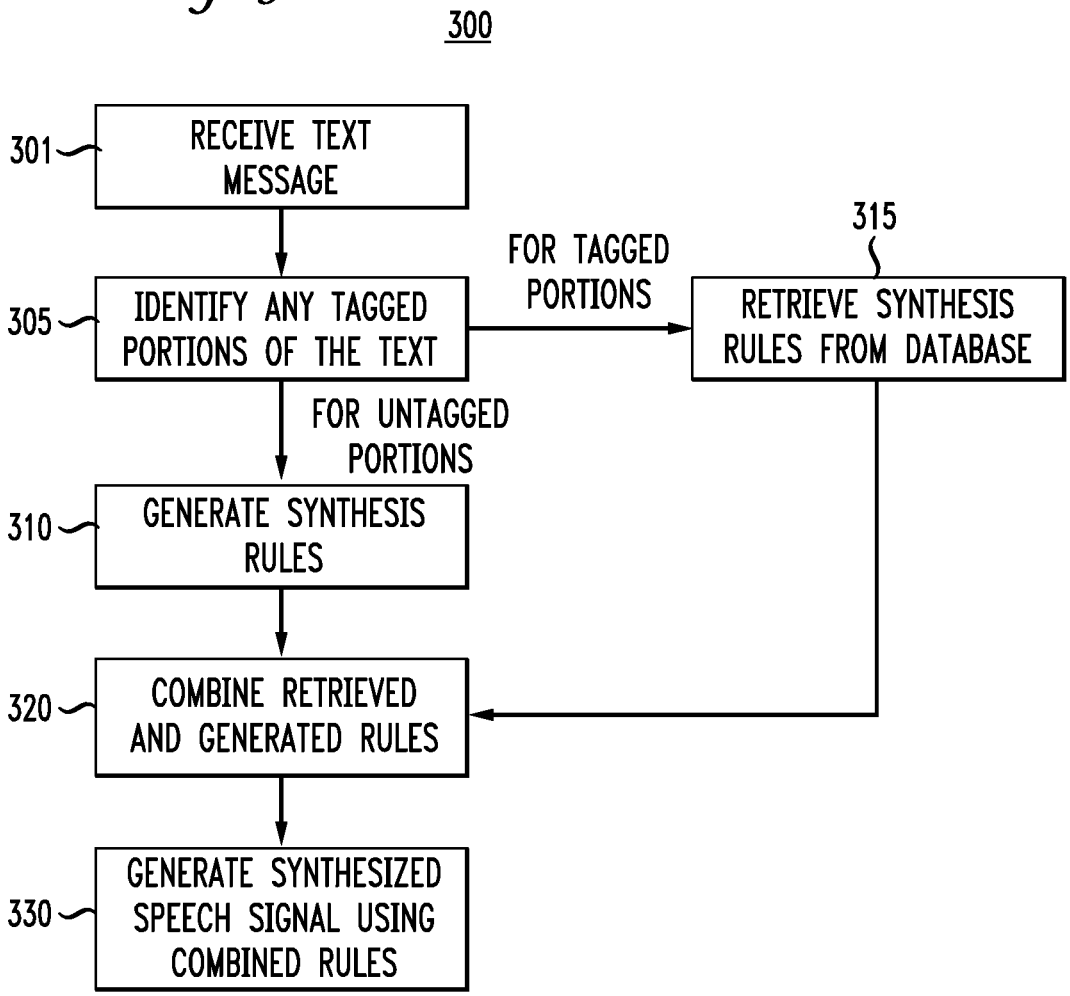
FIG. 3 illustrates a process flow for describing an operation of a process in accordance with an embodiment of the invention.

FIG. 3 provides a flow diagram useful for describing the operations undertaken in the proposed arrangement.

In process 300 the text analysis element 201 receives a text message which can be in ASCII format 301. The analysis element identifies any tagged portions of the message text 305. For untagged portions the analysis element generates synthesis rules or speech-related characteristics (e.g., phoneme, duration, pitch information) in a manner consistent with known text analysis devices such as device 101 in FIG. 1, making reference to a Dictionary and Rules Module 203.

For tagged portions of the message text the analysis element 201 retrieves synthesis rules or speech related characteristics from the database 230 (315). The analysis unit then combines the generated and retrieved speech-related characteristics 320.

The combined generated and retrieved speech related characteristics are forwarded to the assembly unit 210. Together with the stored sound units in database 230 and the synthesizer 220 the system generates a signal representative of synthesized speech based on the combined rules or speech-related characteristics.

Thus, the aim is to be able to use real parameter values from the database in place of calculated parameter values generated by the front end. We want to be able to use these parameters when we desire, not necessarily everywhere. So, for example, suppose for a sentence to be synthesized we know that the associated parameters in the database can be retrieved using an appropriate markup sequence. If this sequence is then presented as input to the unit selection module there is an excellent chance that the units with these exact parameters will be chosen. In this way we can, using markup, effectively call up particular sequences in the database. Moreover, there is (a) a simplification in not having to do special modifications to the unit selection algorithm in order to treat some units differently, and (b) there is also a benefit in that since everything goes through the unit selection algorithm the usual benefits of smooth boundaries and an attempt at global minimum cost are not lost.

CONCLUSION

While various embodiments of the invention have been described above, it should be understood that they have been presented by way of example only, and not limitation. For example although the above methods are shown and described above as a series of operations occurring in a particular order, in some embodiments, certain operations can be completed in a parallel fashion. In other embodiments, the operations can be completed in an order that is different from that shown and described above.

What is claimed is:

1. A method comprising:

receiving a text message for conversion to speech, the text message having a tagged portion and a non-tagged portion;

identifying a topic domain associated with the text message;

selecting, via a text-to-speech device, first phonemes from a phoneme database for the non-tagged portion based on first speech-related characteristics, wherein the phoneme database is specific to the topic domain and comprises phonemes labeled by database tags;

generating first speech synthesis rules for the non-tagged portion based on the first speech-related characteristics;

selecting second phonemes from the phoneme database based on second speech-related characteristics as indicated by message tags in the tagged portion of the text message, wherein the selecting is based on a matching of the message tags and the database tags, wherein the first phonemes and the second phonemes do not represent pre-recorded speech;

retrieving second speech synthesis rules for the tagged portion based on the second speech-related characteristics; and synthesizing, via the text-to-speech device, speech by combining the first phonemes and the second phonemes using the first speech synthesis rules and the second speech synthesis rules.

2. The method of claim 1, wherein synthesizing speech further comprises executing a unit selection synthesis operation.

3. The method of claim 1, wherein the first speech-related characteristics and the second speech-related characteristics comprise phonemes, durations and pitches associated with parsed portions of the text message.

4. An text-to-speech device having instructions stored which, when executed, cause the text-to-speech device to perform operations comprising:

receiving a text message for conversion to speech, the text message having a tagged portion comprising message tags and a non-tagged portion;

identifying a topic domain associated with the text message;

generating first speech synthesis rules for the non-tagged portion;

retrieving second speech synthesis rules for the tagged portion;

retrieving first phonemes from a phoneme database for the non-tagged portion of the text message;

retrieving second phonemes from the phoneme database for the tagged-portion of the text message, wherein the phoneme database is specific to the topic domain and comprises phonemes labeled by database tags, wherein the retrieving of the first phonemes and the second phonemes is based on a matching of the message tags and the database tags, and wherein the first phonemes and the second phonemes do not represent pre-recorded speech; and combining the first phonemes and the second phonemes to output an audible version of the text message using the first speech synthesis rules and the second speech synthesis rules.

5. The text-to-speech device of claim 4, wherein the first phonemes and the second phonemes are retrieved by executing a unit selection synthesis operation.

6. The text-to-speech device of claim 4, wherein the first phonemes and the second phonemes are retrieved based on speech related characteristics that comprise durations and pitches associated with respective portions of the text message.

7. A method comprising:

receiving text to be converted to speech, the text having a tagged portion and a non-tagged portion;

identifying, via a text-to-speech device, a topic domain associated with the text;

for the non-tagged portion of the text, retrieving first phonemes from a phoneme database having first speech related characteristics, wherein the phoneme database is specific to the topic domain and comprises phonemes labeled by database tags;

generating first speech synthesis rules for the non-tagged portion based on the first speech-related characteristics;

for the tagged portion of the text, retrieving second phonemes from the database, the second phonemes having second speech related characteristics as indicated by message tags associated with the tagged portion, and wherein the retrieving is based on a matching of the message tags and the database tags wherein the first and the second phonemes do not represent pre-recorded speech;

retrieving second speech synthesis rules for the tagged portion based on the second speech-related characteristics; and synthesizing, via the text-to-speech device, speech based on the text by combining the first phonemes and the second phonemes using the first speech synthesis rules and the second speech synthesis rules.

8. The method of claim 7, wherein synthesizing speech further comprises executing a unit selection synthesis operation.

9. The method of claim 7, wherein the first and the second speech related characteristics comprise durations and pitches associated with the text.

* * * * *